US011812833B2

(12) United States Patent
Jin

(10) Patent No.: US 11,812,833 B2
(45) Date of Patent: Nov. 14, 2023

(54) HAIR PULLING DEVICE

(71) Applicant: BingJie Jin, Zhejiang (CN)

(72) Inventor: BingJie Jin, Zhejiang (CN)

( * ) Notice: Subject to any disclaimer, the term of this patent is extended or adjusted under 35 U.S.C. 154(b) by 216 days.

(21) Appl. No.: 17/460,697

(22) Filed: Aug. 30, 2021

(65) Prior Publication Data

US 2021/0386177 A1 Dec. 16, 2021

Related U.S. Application Data

(63) Continuation of application No. PCT/CN2019/116603, filed on Nov. 8, 2019.

(30) Foreign Application Priority Data

Jun. 18, 2019 (CN) ..... 201910525469.X

(51) Int. Cl.
*A45D 26/00* (2006.01)

(52) U.S. Cl.
CPC .... *A45D 26/0033* (2013.01); *A45D 2026/008* (2013.01)

(58) Field of Classification Search
CPC ..... A45D 26/0023; A45D 26/0028; A45D 26/0033; A45D 26/0038; A45D 2026/008
See application file for complete search history.

(56) References Cited

U.S. PATENT DOCUMENTS

2002/0052611 A1* 5/2002 Inoue ..... A45D 26/0028 606/133

* cited by examiner

*Primary Examiner* — Todd J Scherbel

(57) ABSTRACT

A hair pulling device includes a machine body which is provided with a hair clamping support (1) and a driving device. A fixation shaft (3) which is fixed and non-rotary as well as a plurality of positioning frames (2) which are driven by the driving device to rotate around the fixation shaft (3) are disposed on the hair clamping support (1); a plurality of groups of hair clamping assembly units which are rotated with the positioning frames (2) are disposed, along an axial direction of the fixation shaft (3), on the positioning frames (2); the fixation shaft (3) is fixedly sleeved by a positioning shaft (4); The hair pulling device has high hair clamping efficiency and reliable and stable clamping force, and avoids the problems that hair pulling fails due to failure of an elastic part or hair pulling fails due to insufficient clamping force.

15 Claims, 4 Drawing Sheets

HAIR PULLING DEVICE

CROSS-REFERENCE TO RELATED APPLICATIONS

This application is a continuation of International Patent Application No. PCT/CN2019/116603, filed on Nov. 8, 2019, which claims the benefit of priority from Chinese Patent Application No. 201910525469.X, filed on Jun. 18, 2019. The content of the aforementioned applications, including any intervening amendments thereto, is incorporated herein by reference in its entirety.

TECHNICAL FIELD

The present invention relates to a hair removal device, and in particular to an electric hair pulling device.

BACKGROUND OF THE PRESENT INVENTION

A hair removal device is generally used for pulling body hair. Existing hair removal devices mainly have low working efficiency. An existing electric hair pulling device mainly includes a hair pulling device assembly and a motor driving device; the hair pulling device assembly includes a hair pulling support, side supports, a middle shaft, a cylindrical cam, a cylindrical roller assembly, clamping plate assemblies and a reset spring; and each clamping plate assembly includes a static clamping plate and a movable clamping plate. In hair clamping, the movable clamping plate is clamped and opened relative to the static clamping plate through the cylindrical cam and the spring when each clamping plate assembly is rotated. The structure is compact and noise is low. However, working efficiency of the device is low. Each set of clamping plate assembly can only realize hair clamping once during a circle of rotation. In addition, because of the structure, it is impossible to add too many sets of hair pulling assemblies along circumferences of hair pulling device assembly as the hair pulling force can be influenced and the production cost can be greatly increased. In addition, the clamping plate assemblies are clamped and opened by the springs which can easily fail after long time of use, which can surely lead to failure of the hair removal device.

SUMMARY OF THE PRESENT INVENTION

The present invention aims to provide a hair pulling device with high hair pulling efficiency and long service life with respect to the defects in the prior art.

In order to achieve the above purpose, the present invention adopts the following technical solutions: a hair pulling device includes a machine body which is provided with a hair clamping support and a driving device; a fixation shaft which is fixed and non-rotary as well as a plurality of positioning frames which are driven by the driving device to rotate around the fixation shaft are disposed on the hair clamping support; a plurality of groups of hair clamping assembly units which are rotated with the positioning frames are disposed, along an axial direction of the fixation shaft, on the positioning frames; the hair clamping assembly units are pincer-shaped; the fixation shaft is fixedly sleeved by a positioning shaft; a column of first guide raised rail sections extending radially are axially distributed on the upper part of the positioning shaft; the first guide raised rail sections are in corresponding fit with lower parts of the hair clamping assembly units; the hair clamping assembly units are rotated with the positioning frames; and through extrusion driving of the first guide raised rail sections on the positioning shaft towards the positions under the hair clamping assembly units, closing and clamping actions of clamping mouths on the upper parts of the hair clamping assembly units are realized.

As an improvement: each hair clamping assembly unit includes two hair clamping plates and a hinging piece, wherein the upper part of each hair clamping part is a clamping head which can form a clamping mouth oppositely, the middle part is provided with a hinging part which is coordinated with the hinging piece to fix the hair clamping plate, and the lower part is a fork foot; each first guide raised rail section can be in corresponding fit between the fork feet of the two hair clamping plates inside the hair clamping assembly unit; and in action, the first guide raised rail section is extruded between the fork feet of the two hair clamping plates, and the fork feet of the two hair clamping plates inside the hair clamping assembly unit are opened, so that the closing and clamping actions of the clamping mouth on the upper part of the hair clamping assembly unit are realized.

As an improvement: the hinging part at the middle of the hair clamping plate extends towards outside of the hair clamping assembly unit, i.e., the hinging pieces are connected on the hinging parts of the two adjacent hair clamping plates of the two adjacent hair clamping assembly units.

As an improvement: the hinging part at the middle of the hair clamping plate extends towards inside of the hair clamping assembly unit, i.e., the two hair clamping plates of the hair clamping assembly unit are hinged and fixed by the hinging pieces and hinging parts at the middles of the two hair clamping plates inside the hair clamping assembly unit.

As an improvement: a column of second guide raised rail sections extending radially are distributed axially on the lower part of the positioning shaft, wherein the first guide raised rail sections and the second guide raised rail sections are arranged in a staggered manner on an axial position; the second guide raised rail sections are in corresponding fit between the two adjacent hair clamping assembly units; the second guide raised rail sections on the positioning shaft are extruded between the two hair clamping assembly units, so that opening actions of the clamping mouths on the upper parts of the hair clamping assembly units are realized; first guide parts which guide each hair clamping assembly unit to be gradually opened and closed and are conical are disposed on both ends of each guide raised rail section; and second guide parts which guide each hair clamping assembly unit to be gradually opened and closed and are conical are disposed on both ends of each second guide raised rail section.

As an improvement: the first guide parts of each first guide raised rail section and the second guide parts of each second guide raised rail section are arranged in a staggered and parallel manner at the axial position, i.e., at a radial position of the positioning shaft, a cone top of each first guide part of the first guide raised rail section is corresponding to a cone bottom of each second guide part of the second guide raised rail section; and a cone top of each second guide part of the second guide raised rail section is corresponding to a cone bottom of each first guide part of the first guide raised rail section.

As an improvement: the lower part of each hair clamping assembly unit is further sleeved by guide blocks, wherein the hair clamping assembly unit is coordinated with the positioning shaft by the guide blocks.

As an improvement: an opening assisting elastic part is further disposed inside the hair clamping assembly unit.

In the hair pulling device provided by the present invention, the first guide raised rail sections are used for realizing the closing and clamping actions of the clamping mouths on the upper part of the hair clamping assembly units. The hair clamping efficiency is high; clamping force is reliable and stable; and problems that hair pulling fails due to failure of the elastic part or hair pulling fails due to insufficient clamping force can be avoided. Further, a unit combination mode is adopted in the design. Each hair clamping assembly unit is of a same structure, so that processing is convenient; production cost is greatly reduced; an integral-machine structure is simplified; there are only a few of scattered components; repaid and assembly are easy; and work is stable. In addition, the design may be a design of multiple positioning frames which can be disposed in an equally divided and surrounded manner. Hair pulling can be conducted for many times in a circle of rotation. The number of hair clamping points is maximized, so that a hair pulling action can be effectively and rapidly completed.

In order to make the purposes, technical solutions and advantages of the present invention clearer, further detailed description will be made for the present invention below in conjunction with the accompanying drawings.

DETAILED DESCRIPTION OF THE PRESENT INVENTION

Figure 1:
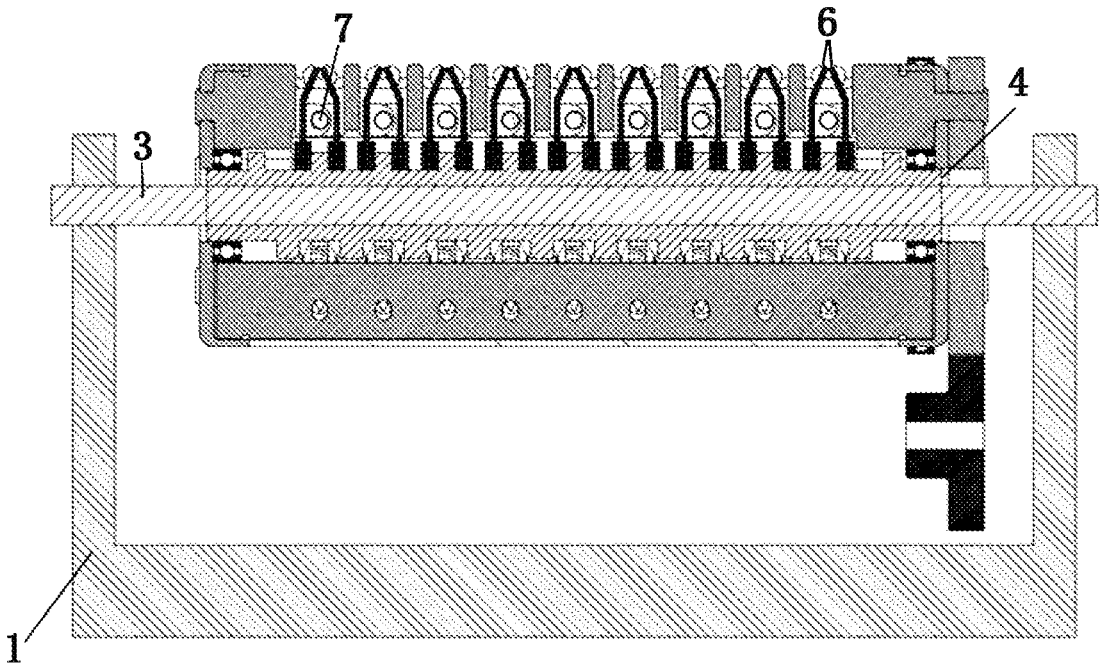
FIG. 1 is a structural schematic diagram of a first embodiment of a hair pulling device of the present invention.
Figure 2:
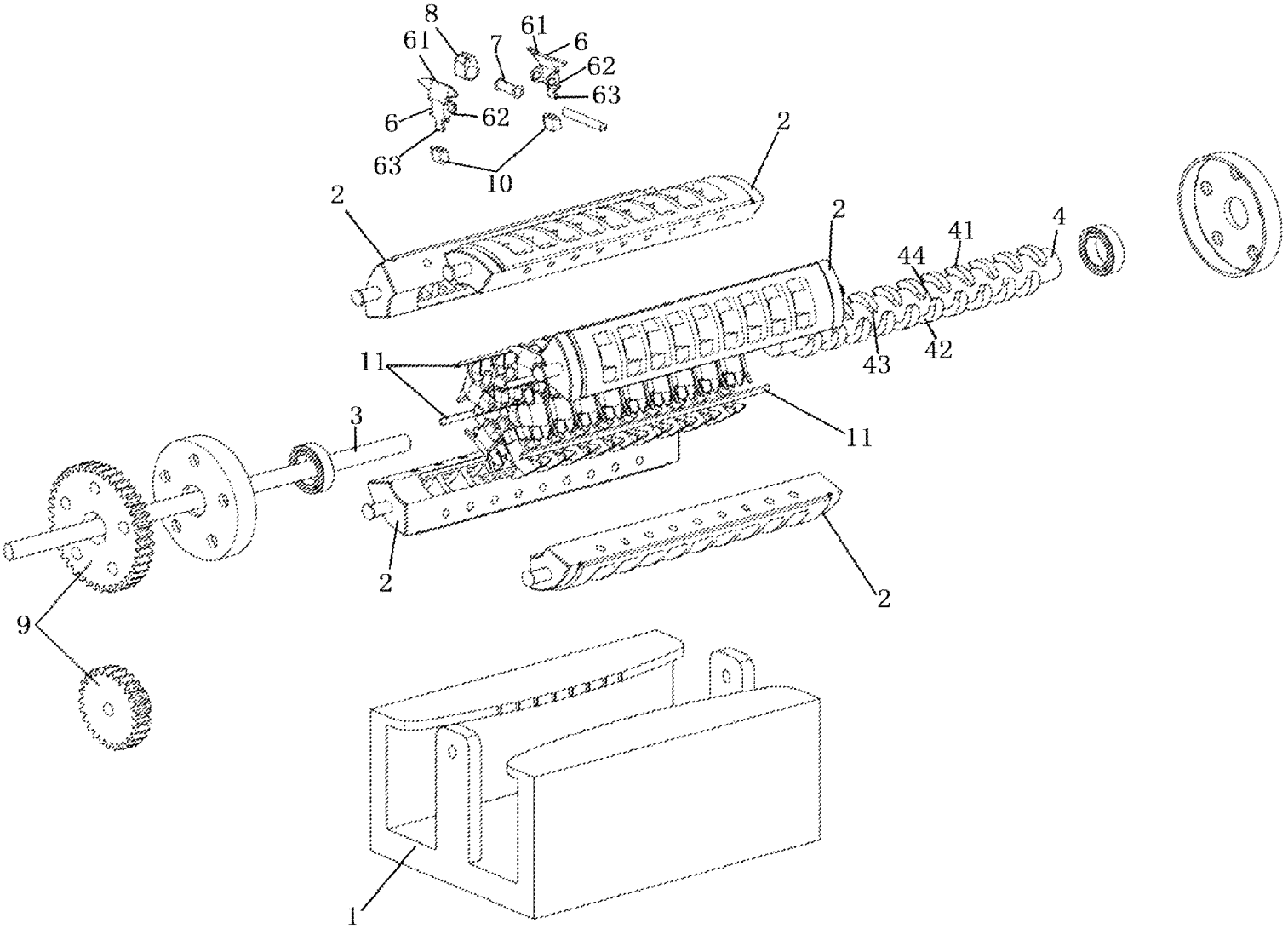
FIG. 2 is an exploded drawing of FIG. 1.

As shown in FIG. 1 and FIG. 2, in a first embodiment of a hair pulling device of the present invention, the hair pulling device includes a machine body which is provided with a hair clamping support and a driving device; a fixation shaft 3 which is fixed and non-rotary as well as five positioning frames 2 which are driven by the driving device to rotate around the fixation shaft 3 are disposed on the hair clamping support 1; and the five positioning frames are disposed in an equally divided and surrounded manner and are installed and connected at intervals by lubricating bars 11, so as to enhance hair pulling comfort. The driving device in the present embodiment drives an end cap 5 and each positioning frame connected to the end cap 5 to rotate by a gear set 9; a plurality of positioning holes are arranged and formed in the positioning frame; and a plurality of groups of hair clamping assembly units which are rotated with the positioning frames 2 are disposed, along an axial direction of the fixation shaft 3, on the positioning frames 2, namely the hair clamping assembly units are installed in the positioning holes. The hair clamping assembly units are pincer-shaped; the fixation shaft 3 is fixedly sleeved by a positioning shaft 4; a column of first guide raised rail sections 41 extending radially are axially distributed on the upper part of the positioning shaft 4; a column of second guide raised rail sections 42 extending radially are distributed axially on the lower part of the positioning shaft 4; the first guide raised rail sections 41 are in corresponding fit with lower parts of the hair clamping assembly units; and the second guide raised rail sections 42 are in corresponding fit between the two adjacent hair clamping assembly units, so that the first guide raised rail sections 41 and the second guide raised rail sections 42 are arranged in a staggered manner on an axial position. Each hair clamping assembly unit is rotated with the positioning frame 2. Through extrusion driving of the first guide raised rail sections 41 on the positioning shaft 4 towards the positions under the hair clamping assembly units, closing and clamping actions of clamping mouths on the upper parts of the hair clamping assembly units are realized. The second guide raised rail sections 42 on the positioning shaft 4 are extruded between the two hair clamping assembly units, so that opening actions of the clamping mouths on the upper parts of the hair clamping assembly units are realized. Stable opening and closing of the clamping mouths on the upper parts of the hair clamping assembly units are guaranteed.

In the present embodiment, each hair clamping assembly unit includes two hair clamping plates 6 and a hinging piece 7; the upper part of each hair clamping part 6 is a clamping head 61 which can form a clamping mouth oppositely, the middle part is provided with a hinging part 62 which is coordinated with the hinging piece to fix the hair clamping plate, and the lower part is a fork foot 63; each first guide raised rail section 41 can be in corresponding fit between the fork feet 63 of the two hair clamping plates inside the hair clamping assembly unit; and in action of the first guide raised rail section 41, the first guide raised rail section 41 is extruded between the fork feet 63 of the two hair clamping plates, and the fork feet 63 of the two hair clamping plates inside the hair clamping assembly unit are opened, so that the closing and clamping actions of the clamping mouth on the upper part of the hair clamping assembly unit are realized. In action of the second guide raised rail section 42, the second guide raised rail section 42 is extruded between the two air clamping assembly units, i.e., outer walls of the hinging parts 62 of the two adjacent hair clamping plates of the two adjacent hair clamping assembly units are extruded, so that the opening actions of the clamping mouths on the upper parts of the hair clamping assembly units are realized. In the present embodiment, to ensure that the clamping mouths can be effectively and gradually opened and prevent hair from entering between the hair clamping assembly units, an opening assisting elastic part 8 is further disposed in each clamping mouth of the hair clamping assembly unit. Of course, an elastic part may be added at hinging part 62.

In the present embodiment, in order to realize stable transition of state conversion of the clamping mouths, the column of second guide raised rail sections 42 extending radially are distributed axially on the lower part of the positioning shaft 4; the first guide raised rail sections 41 and the second guide raised rail sections 42 are arranged in a staggered manner on an axial position; the second guide raised rail sections 42 are in corresponding fit between the two adjacent hair clamping assembly units; the second guide raised rail sections 42 on the positioning shaft 4 are extruded between the two hair clamping assembly units, so that the opening actions of the clamping mouths on the upper parts of the hair clamping assembly units are realized; first guide parts 43 which guide each hair clamping assembly unit to be gradually opened and closed and are conical are disposed on both ends of each guide raised rail section 41; and second guide parts 44 which guide each hair clamping assembly unit to be gradually opened and closed and are conical are disposed on both ends of each second guide raised rail section 42. The first guide parts 43 of each first guide raised rail section 41 and the second guide parts 44 of each second guide raised rail section 42 are arranged in a staggered and parallel manner at the axial position, i.e., at a radial position of the positioning shaft 4, a cone top of each first guide part 43 of the first guide raised rail section 41 is corresponding to a cone bottom of each second guide part 44 of the second guide raised rail section 42; and a cone top of each second guide part 44 of the second guide raised rail section 42 is corresponding to a cone bottom of each first guide part 43 of the first guide raised rail section 41. The fork feet at the lower part of each hair clamping assembly unit are further sleeved by guide blocks 10; and the hair clamping assembly unit is coordinated with the positioning shaft 4 by the guide blocks 10. The guide blocks not only can make relative motion between the hair clamping assembly unit and the positioning shaft 4 more stable and smoother, and realize close coordination, damping and noise reduction, but also can slightly adjust rail widths relative to the first guide raised rail sections 41 and the second guide raised rail sections 42.

Figure 3:
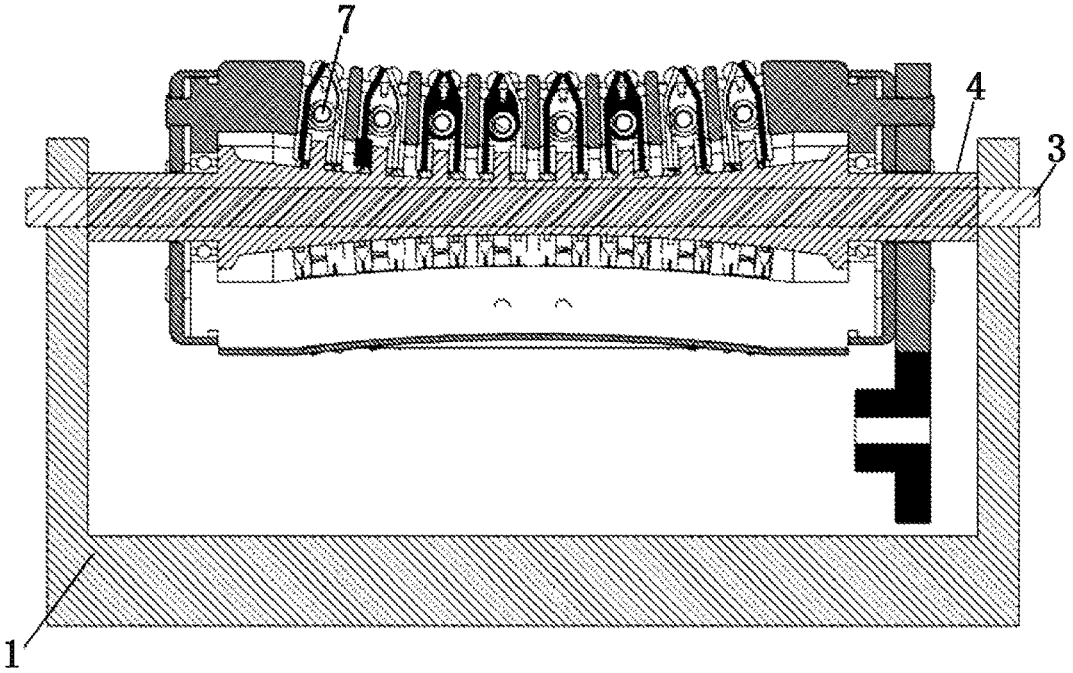
FIG. 3 is a structural schematic diagram of a second embodiment of a hair pulling device of the present invention.
Figure 4:
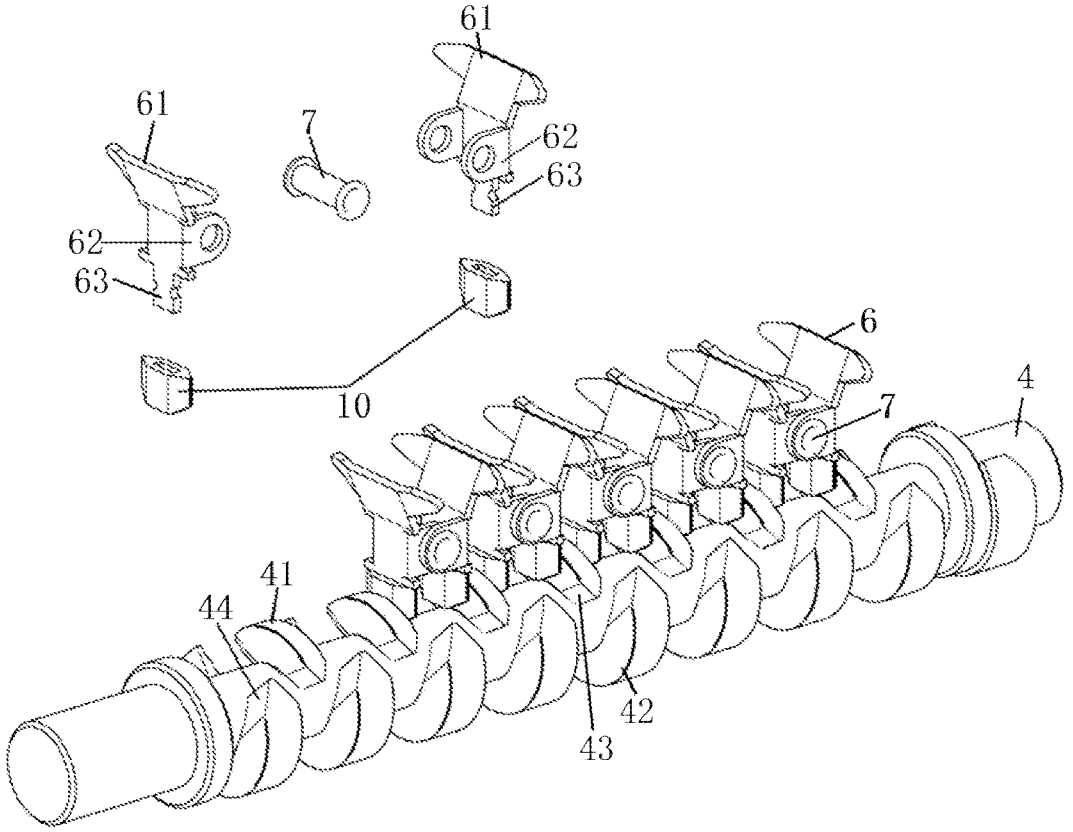
FIG. 4 is a structural schematic diagram of a third embodiment of a hair pulling device of the present invention.
Figure 5:
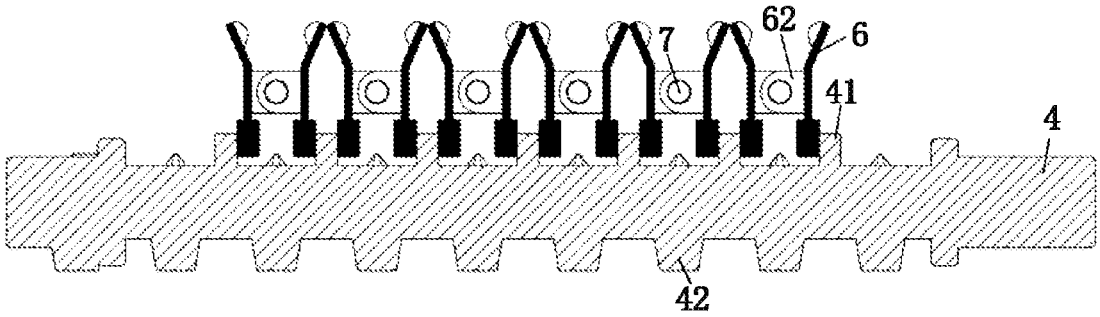
FIG. 5 is a structural schematic diagram of a hair clamping assembly unit in FIG. 4.

In the present embodiment, the hinging part 62 at the middle of the hair clamping plate extends towards inside of the hair clamping assembly unit, i.e., the two hair clamping plates of the hair clamping assembly unit are hinged and fixed by the hinging pieces 7 and hinging parts 62 at the middles of the two hair clamping plates inside the hair clamping assembly unit. The structure can effectively guarantee symmetry and centrality of both sides of the hair clamping assembly unit to facilitate special-shaped design of the positioning shaft 4. In the second embodiment as shown in FIG. 3, the peripheral wall of the positioning shaft 4 may be of a certain radian, to improve the skin fit of the hair clamping device. Of course, the design of making the hinging part 62 at the middle of the hair clamping plate extend towards outside of the hair clamping assembly unit can be adopted. In the third embodiment as shown in FIG. 4 and FIG. 5, the hinging pieces 7 are connected on the hinging parts 62 of the two adjacent hair clamping plates of the two adjacent hair clamping assembly units.

The present invention is disclosed with the above specific embodiments, but the embodiments are not used for limiting the present invention. Any of those skilled in the art still can make several changes and modifications without departing from the spirit and scope of the present invention. Therefore, the protection scope of the present invention shall be defined by the scope of the attached claims.

What is claimed is:

1. A hair pulling device, comprising a machine body which is provided with a hair clamping support and a driving device, wherein a fixation shaft which is fixed and non-rotary as well as a plurality of positioning frames which are driven by the driving device to rotate around the fixation shaft are disposed on the hair clamping support; a plurality of groups of hair clamping assembly units which are rotated with the positioning frames are disposed, along an axial direction of the fixation shaft, on the positioning frames; the hair clamping assembly units are pincer-shaped; the fixation shaft is fixedly sleeved by a positioning shaft; a column of first guide raised rail sections extending radially are axially distributed on an upper part of the positioning shaft; the first guide raised rail sections are in corresponding fit with lower parts of the hair clamping assembly units; the hair clamping assembly units are rotated with the positioning frames; and through extrusion driving of the first guide raised rail sections on the positioning shaft towards the positions under the hair clamping assembly units, closing and clamping actions of clamping mouths on upper parts of the hair clamping assembly units are realized; and wherein a column of second guide raised rail sections extending radially are distributed axially on a lower part of the positioning shaft; the first guide raised rail sections and the second guide raised rail sections are arranged in a staggered manner on an axial position; the second guide raised rail sections are in corresponding fit between the two adjacent hair clamping assembly units; the second guide raised rail sections on the positioning shaft are extruded between the two hair clamping assembly units, so that opening actions of the clamping mouths on the upper parts of the hair clamping assembly units are realized; first guide parts which guide each hair clamping assembly unit to be gradually opened and closed and are conical are disposed on both ends of each first guide raised rail section; and second guide parts which guide each hair clamping assembly unit to be gradually opened and closed and are conical are disposed on both ends of each second guide raised rail section.

2. The hair pulling device according to claim 1, wherein each hair clamping assembly unit comprises two hair clamping plates and a hinging piece; an upper part of each hair clamping part plate is a clamping head which can form a clamping mouth oppositely, a middle part is provided with a hinging part which is coordinated with the hinging piece to fix each hair clamping plate, and a lower part is a fork foot; each first guide raised rail section can be in corresponding fit between the fork feet of the two hair clamping plates inside the hair clamping assembly unit; and in action, the first guide raised rail section is extruded between the fork feet of the two hair clamping plates, and the fork feet of the two hair clamping plates inside the hair clamping assembly unit are opened, so that the closing and clamping actions of the clamping mouth on the upper part of the hair clamping assembly unit are realized.

3. The hair pulling device according to claim 2, wherein the hinging part at the middle part of each hair clamping plate extends towards outside of the hair clamping assembly unit, and the hinging pieces are connected on the hinging parts of the two adjacent hair clamping plates of the two adjacent hair clamping assembly units.

4. The hair pulling device according to claim 3, wherein the lower part of each hair clamping assembly unit is further sleeved by guide blocks; and the hair clamping assembly unit is coordinated with the positioning shaft by the guide blocks.

5. The hair pulling device according to claim 3, wherein an opening assisting elastic part is further disposed inside the hair clamping assembly unit.

6. The hair pulling device according to claim 2, wherein the hinging part at the middle part of the hair clamping plate extends towards inside of the hair clamping assembly unit, and the two hair clamping plates of the hair clamping assembly unit are hinged and fixed by the hinging pieces and hinging parts at the middles of the two hair clamping plates inside the hair clamping assembly unit.

7. The hair pulling device according to claim 6, wherein the lower part of each hair clamping assembly unit is further sleeved by guide blocks; and the hair clamping assembly unit is coordinated with the positioning shaft by the guide blocks.

8. The hair pulling device according to claim 6, wherein an opening assisting elastic part is further disposed inside the hair clamping assembly unit.

9. The hair pulling device according to claim 2, wherein the lower part of each hair clamping assembly unit is further sleeved by guide blocks; and the hair clamping assembly unit is coordinated with the positioning shaft by the guide blocks.

10. The hair pulling device according to claim 2, wherein an opening assisting elastic part is further disposed inside the hair clamping assembly unit.

11. The hair pulling device according to claim 1, wherein the first guide parts of each first guide raised rail section and the second guide parts of each second guide raised rail section are arranged in a staggered and parallel manner at the axial position, at a radial position of the positioning shaft, a cone top of each first guide part of the first guide raised rail section is corresponding to a cone bottom of each second guide part of the second guide raised rail section; and a cone top of each second guide part of the second guide raised rail section is corresponding to a cone bottom of each first guide part of the first guide raised rail section.

12. The hair pulling device according to claim 11, wherein the lower part of each hair clamping assembly unit is further sleeved by guide blocks; and the hair clamping assembly unit is coordinated with the positioning shaft by the guide blocks.

13. The hair pulling device according to claim 1, wherein the lower part of each hair clamping assembly unit is further sleeved by guide blocks; and the hair clamping assembly unit is coordinated with the positioning shaft by the guide blocks.

14. The hair pulling device according to claim 1, wherein the lower part of each hair clamping assembly unit is further sleeved by guide blocks; and the hair clamping assembly unit is coordinated with the positioning shaft by the guide blocks.

15. The hair pulling device according to claim 1, wherein an opening assisting elastic part is further disposed inside the hair clamping assembly unit.

* * * * *